US010241446B2

(12) United States Patent
Honya et al.

(10) Patent No.: US 10,241,446 B2
(45) Date of Patent: Mar. 26, 2019

(54) INTERMEDIATE TRANSFER MEMBER AND IMAGE FORMING APPARATUS

(71) Applicant: Konica Minolta, Inc., Tokyo (JP)

(72) Inventors: Akihiro Honya, Tokyo (JP); Shinichi Hamaguchi, Tokyo (JP); Shinichi Yabuki, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 220 days.

(21) Appl. No.: 15/363,601

(22) Filed: Nov. 29, 2016

(65) Prior Publication Data

US 2017/0168428 A1 Jun. 15, 2017

(30) Foreign Application Priority Data

Dec. 10, 2015 (JP) ..... 2015-241399

(51) Int. Cl.
*G03G 15/16* (2006.01)

(52) U.S. Cl.
CPC ..... *G03G 15/162* (2013.01); *G03G 2215/16* (2013.01)

(58) Field of Classification Search
CPC ..... C08F 8/14; C08F 261/06; C08F 265/02; G03G 15/16–15/1695
See application file for complete search history.

(56) References Cited

U.S. PATENT DOCUMENTS

2008/0166495 A1 7/2008 Maeno et al.
2012/0064350 A1 3/2012 Honya et al.
2014/0286682 A1 9/2014 Sakamoto et al.

FOREIGN PATENT DOCUMENTS

EP 2237115 A1 10/2010
JP 2013024898 A 2/2013

OTHER PUBLICATIONS

Extended European Search Report dated Jun. 19, 2017 from corresponding European Application No. 16200877.5.

*Primary Examiner* — Ramsey Zacharia
(74) *Attorney, Agent, or Firm* — Lucas & Mercanti, LLP

(57) ABSTRACT

The present invention relates to an intermediate transfer member and an image forming apparatus. The intermediate transfer member is an intermediate transfer member having a resin-made base material layer and a surface layer; the surface layer is a cured substance of a composition containing a radically polymerizable vinylic compound and a metal oxide fine particle; and the vinylic compound has a structural unit represented by the following formula (1):

[Formula 1]

(1)

wherein each $R^1$ independently denotes a $C_{2-8}$ alkylene group; each $R^2$ independently denotes a hydrogen atom or a methyl group; and m denotes a positive number, and n denotes a positive number of 10 or more.

15 Claims, 2 Drawing Sheets

INTERMEDIATE TRANSFER MEMBER AND IMAGE FORMING APPARATUS

CROSS REFERENCE TO RELATED APPLICATIONS

This application is entitled to and claims the benefit of Japanese Patent Application No. 2015-241399, filed on Dec. 10, 2015, the disclosure of which including the specification, drawings and abstract is incorporated herein by reference in its entirety.

BACKGROUND OF THE INVENTION

1. Field of the Invention

The present invention relates to an intermediate transfer member and an image forming apparatus having the intermediate transfer member.

2. Description of Related Art

Electrophotographic image forming apparatuses carry out, for example, developing latent images formed on a photoconductor by a toner, making the obtained toner images to be temporarily held on an endless belt-shape intermediate transfer member, and transferring the toner images on the intermediate transfer member onto a recording material such as paper. As the shape of the intermediate transfer member, for example, an endless belt (intermediate transfer belt) is known (for example, Japanese Patent Application Laid-Open No. 2013-024898).

An intermediate transfer belt described in PTL 1 has a resin-made base material layer, and an elastic layer disposed on the surface of the base material layer. The elastic layer is constituted of an organic-inorganic hybrid material obtained by mixing a radically polymerizable monomer with an inorganic fine particle, and irradiating and polymerizing the radically polymerizable monomer with actinic radiation. Since the elastic layer of the intermediate transfer belt described in PTL 1 can thus be formed by irradiation with actinic radiation, it can be manufactured inexpensively.

Further, the intermediate transfer belt described in PTL 1 is stretched by a plurality of rollers in an image forming apparatus. Further, the intermediate transfer belt described in PTL 1 runs in one direction on an endless track by the rotation-drive of the rollers at the time of forming images.

Since the flexibility of the elastic layer is low in the intermediate transfer belt described in PTL 1, however, there is a problem in which cracks occur due to deformation when the intermediate transfer belt runs on the endless track at the time of forming images. It is thus difficult to simultaneously satisfy both the reduction of manufacture costs and the durability of the intermediate transfer belt.

SUMMARY OF THE INVENTION

Then, an object of the present invention is to provide an intermediate transfer member which can be manufactured at a low cost and has durability, and an image forming apparatus having the intermediate transfer member.

To achieve at least one of the abovementioned objects, an intermediate transfer member reflecting one aspect of the present invention, comprises a base material layer; and a surface layer on the base material layer, wherein the surface layer is a cured substance of a composition comprising a radically polymerizable vinylic compound and a metal oxide fine particle; and the vinylic compound has a structural unit represented by the following formula (1):

[Formula 1]

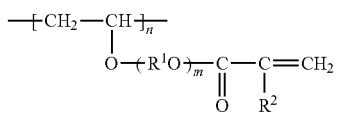

(1)

wherein each R1 independently denotes a C2-8 alkylene group; each R2 independently denotes a hydrogen atom or a methyl group; and m denotes a positive number, and n denotes a positive number of 10 or more.

Also, to achieve at least one of the abovementioned objects, an image forming apparatus according to another aspect of the present invention, comprises an intermediate transfer member according to one aspect of the present invention for transferring a toner image formed on a photoconductor to a recording medium.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, one embodiment according to the present invention will be described in detail by reference to the accompanying drawings.

(Constitution of Image Forming Apparatus)

Figure 1:
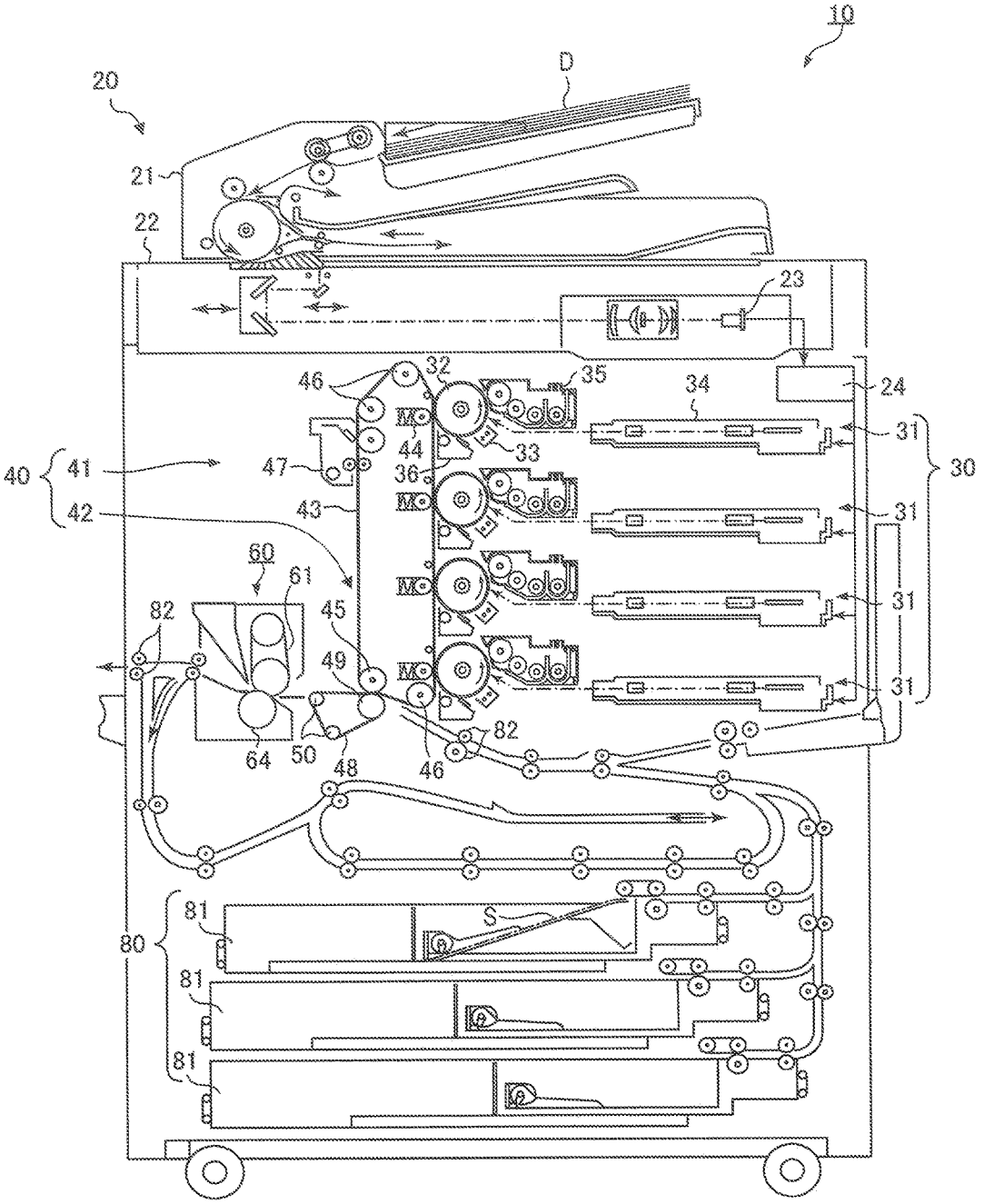
FIG. 1 is a diagram illustrating a constitution of an image forming apparatus according to one embodiment of the present invention.

FIG. 1 is a diagram illustrating a constitution of image forming apparatus 10.

As illustrated in FIG. 1, image forming apparatus 10 has image reading section 20, image forming section 30, intermediate transfer section 40, fixing device 60, and recording medium conveying section 80.

Image reading section 20 reads images from manuscripts D and obtains image data to form electrostatic latent images. Image reading section 20 has sheet feeding device 21, scanner 22, CCD sensor 23, and image processing section 24.

Image forming section 30 contains four image forming units 31 corresponding to respective colors of, for example, yellow, magenta, cyan and black. Image forming units 31 each have photoconductor drum 32, charging device 33, exposing device 34, developing device 35 and cleaning device 36.

Photoconductor drum 32 is, for example, an organic photoconductor of negatively charging type having photoconductivity. Charging device 33 charges photoconductor drum 32. Charging device 33 is, for example, a corona charging device. Charging device 33 may be a contact charging device to bring a contact charging member such as a charging roller, a charging brush or a charging blade into contact with photoconductor drum 32 to thereby charge photoconductor drum 32. Exposing device 34 irradiates the charged photoconductor drum 32 with light to thereby form electrostatic latent images. Exposing device 34 is, for example, a semiconductor laser. Developing device 35 feeds a toner to photoconductor drum 32 having the electrostatic latent images formed thereon to thereby form toner images corresponding to the electrostatic latent images. Developing device 35 is, for example, a well-known developing device in an electrophotographic image forming apparatus. Cleaning device 36 removes remaining toner on photoconductor drum 32. Here, "toner images" refer to a state in which the toner is collected imagewisely.

As the toner, a well-known toner can be used. The toner may be a one-component developer or may be a two-component developer. The one-component developer is constituted of toner particles. The two-component developer is constituted of toner particles and carrier particles. The toner particle is constituted of a toner base particle and external additives such as silica attached on its surface. The toner base particle is constituted of, for example, a binder resin, a colorant and a wax.

Intermediate transfer section 40 contains primary transfer unit 41 and secondary transfer unit 42.

Primary transfer unit 41 has intermediate transfer belt 43, primary transfer roller 44, backup roller 45, a plurality of first supporting rollers 46 and cleaning device 47. Intermediate transfer belt 43is an endless belt. Intermediate transfer belt (intermediate transfer member) 43 is stretched by backup roller 45 and first supporting rollers 46. Intermediate transfer belt 43 runs in one direction at a constant rate on the endless track by rotation-drive of at least one roller of backup roller 45 and first supporting rollers 46. Since one of the features of the present embodiments is intermediate transfer belt 43, the detailed description of intermediate transfer belt 43 will be described later.

Secondary transfer unit 42 has secondary transfer belt 48, secondary transfer roller 49, and a plurality of secondary supporting rollers 50. Secondary transfer belt 48 is an endless belt. Secondary transfer belt 48 is stretched by secondary transfer roller 49 and secondary supporting rollers 50.

Fixing device 60 has fixing belt 61, a heating roller, a first pressure roller, second pressure roller 64, a heater, a first temperature sensor, a second temperature sensor, an airflow separator, a guide plate and a guide roller.

Fixing belt 61 has a base layer, an elastic layer and a release layer laminated in the order mentioned. Fixing belt 61 is rotatably supported in the state that the base layer is directed inward and the release layer is directed outward by the heating roller and the first pressure roller. The tension of fixing belt 61 is, for example, 43 N.

The heating roller has a rotatable aluminum-made sleeve, and a heater disposed inside the sleeve. The first pressure roller has, for example, a rotatable core metal, and an elastic layer disposed on the outer peripheral surface thereof.

Second pressure roller 64 is disposed facing the first pressure roller through fixing belt 61. Second pressure roller 64 has, for example, a rotatable aluminum-made sleeve, and a heater disposed in the sleeve. Second pressure roller 64 is disposed approachably to and separably from the first pressure roller; and second pressure roller 64, when approaching the first pressure roller, pressurizes the elastic layer of the first pressure roller through fixing belt 61 to thereby form a fixing nip portion being a contact portion with fixing belt 61.

The first temperature sensor is a device to detect the temperature of fixing belt 61 heated by the heating roller. Further, the second temperature sensor is a device to detect the temperature of the outer peripheral surface of the second pressure roller 64.

The airflow separator is a device to generate airflow toward the fixing nip portion from the downstream side in the moving direction of fixing belt 61, and promote separation of recording medium S from fixing belt 61.

The guide plate is a member to guide recording medium S having unfixed toner images to the fixing nip portion. The guide roller is a member to guide the recording medium having fixed toner images from the fixing nip portion out of image forming apparatus 10.

Recording medium conveying section 80 has three sheet feeding tray units 81 and a plurality of registration roller pairs 82. Sheet feeding tray units 81 accommodate recording medium S (standard paper, special paper and the like in the present embodiments) identified based on basis weight, size or the like for each kind thereof previously established. Registration roller pairs 82 are disposed so as to form predetermined conveying paths.

In such image forming apparatus 10, toner images are formed on recording medium S sent by recording medium conveying section 80 in intermediate transfer section 40, based on image data acquired by image reading section 20. Recording medium S having the toner images formed in intermediate transfer section 40 is sent to fixing device 60. In fixing device 60, unfixed toner images are quickly fixed on recording medium S by tight contact of fixing belt 61 on recording medium S. The recording medium separated from fixing belt 61 is guided toward the outside of image forming apparatus 10 by the guide roller.

(Constitution of Intermediate Transfer Belt)

Figure 2A:
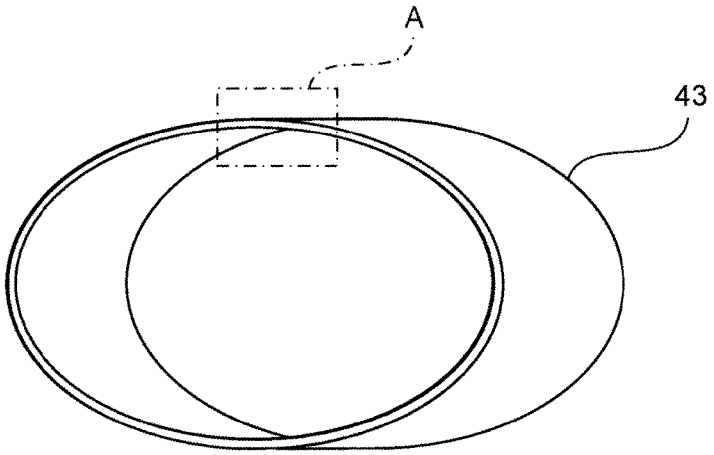
FIG. 2A is a diagram schematically illustrating one example of an intermediate transfer belt according to one embodiment of the present invention.
Figure 2B:
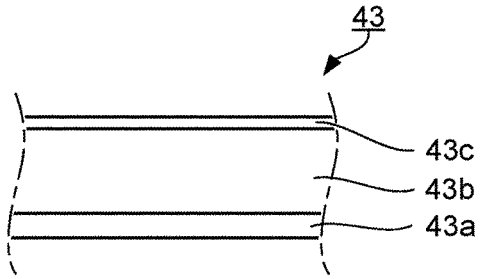
FIG. 2B is an enlarged diagram of a region A illustrated in FIG. 2A.

Then, by reference to accompanying FIG. 2, intermediate transfer belt 43 will be described in detail. FIG. 2A is a perspective diagram of intermediate transfer belt 43; FIG. 2B is an enlarged diagram of a region A illustrated in FIG. 2A; and FIG. 2C is a partially enlarged cross-sectional diagram of intermediate transfer belt 43 according to another embodiment.

Figure 2C:
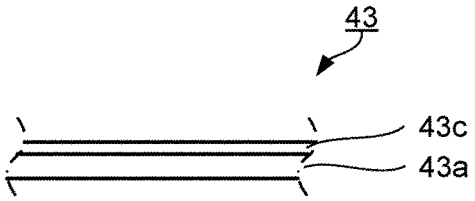
FIG. 2C is a partially enlarged cross-sectional diagram of an intermediate transfer belt according to another embodiment.

As illustrated in FIGS. 2A, 2B and 2C, intermediate transfer belt 43 has base material layer 43*a* and surface layer 43*c*. Further, in intermediate transfer belt 43, base material layer 43*a* is located on the inner side; and surface layer 43*c* is located on the outer side. Here, elastic layer 43*b* may be provided between base material layer 43*a* and surface layer 43*c*.

Base material layer 43*a* is made of a thermoplastic resin or a thermosetting resin. The thermoplastic resin and the thermosetting resin can suitably be selected from resins causing no modification and no deformation in the use temperature range of intermediate transfer belt 43. Examples of the thermoplastic resin and the thermosetting resin include polycarbonate, polyphenylene sulfide, polyvinylidene fluoride, polyimide, polyamideimide, polyalkylene terephthalate (polyethylene terephthalate, polybutylene terephthalate, and the like), polyether, polyether ketone, polyether ether ketone, ethylene-etrafluoroethylene copolymer and polyamide. The heat-resistant resin to be used may be used singly or concurrently in two or more thereof. The resin to be used for base material layer 43*a* is, from the viewpoint of the heat resistance and the strength, preferably polyimide, polycarbonate, polyphenylene sulfide or polyalkylene terephthalate. Further, the resin to be used for base material layer 43*a* more preferably includes polyphenylene sulfide or polyimide. The polyimide can be obtained by heating a polyamic acid, which is a precursor of the polyimide. Further the polyamic acid can be obtained by dissolving a nearly equimolar mixture of a tetracarboxylic dianhydride or its derivative and a diamine in an organic polar solvent, and allowing the mixture to react in a solution state.

Base material layer 43*a* preferably has an electric resistance value (volume resistivity) in the range of $10^5$ to $10^{11}$ Ω·cm. In order to make the electric resistance value of base material layer 43*a* to be in a predetermined range, base material layer 43*a* has only to contain a conductive substance, for example. Examples of the conductive substance include carbon black. As the carbon black, neutral or acidic carbon black can be used. The conductive substance may be added at an amount that makes the volume resistance value and the surface resistance value of intermediate transfer belt 43 fall in predetermined ranges, although the amount depends on the kind of the conductive substance. Usually, the conductive substance may be added at an amount in the range of 10 to 20 parts by weight with respect to 100 parts by weight of the resin; preferably, the conductive substance may be added at an amount in the range of 10 to 16 parts by weight with respect to 100 parts by weight of the resin.

The thickness of base material layer 43*a* is preferably in the range of 50 to 200 μm. Well-known various types of additives may further be added to base material layer 43*a* as long as base material layer 43*a* has the above-mentioned function. Examples of the additives include dispersants such as nylon compounds.

Base material layer 43*a* can be manufactured by a conventionally well-known usual method. For example, base material layer 43*a* can be manufactured in a ring-form (endless belt-shape) by melting a heat-resistant resin to become the material by an extruder, molding the melted resin into a cylindrical form by an inflation process using a ring die, and thereafter cutting the cylinder into a ring.

The elastic layer is constituted of an elastic body. Examples of the elastic body include rubbers, elastomers and resins. The elastic body, from the viewpoint of the durability, preferably includes chloroprene rubber. The thickness of such an elastic layer is, from the viewpoint of the mechanical strength, the image quality, the manufacture costs and the like, preferably in the range of 100 to 500 μm.

Surface layer 43*c* is a cured substance of a composition containing a radically polymerizable vinylic compound and a metal oxide fine particle by radical polymerization of the vinylic compound. That is, surface layer 43*c* contains a structural unit derived from a vinylic compound represented by the formula (1) described later, and a metal oxide fine particle.

The radically polymerzable vinylic compound contains at least a structural unit represented by the following formula (1) In the following formula (1), each $R^1$ independently denotes a $C_{2-8}$ alkylene group; each $R^2$ independently denotes a hydrogen atom or a methyl group; and m denotes a positive number, and n denotes a positive number of 10 or more.

[Formula 2]

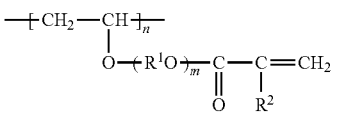

(1)

$R^1O$ in the above formula (1) imparts pliability to surface layer 43*c*. The integer m in the above formula (1) is preferably in the range of 1 to 5. When the integer m in the above formula (1) is in the range of 1 to 5, since a predetermined hardness is easily imparted to surface layer 43*c*, it is preferable.

Further when the number of carbon atoms in $R^1O$ is 1, a risk arises that the hardness of surface layer 43*c* becomes too high. Further, when the number of carbon atoms in $R^1O$ is 9 or more, a risk arises that surface layer 43*c* softens to excess.

Further the integer n (degree of polymerization) in the above formula (1) is a positive number of 10 or more. Here, the integer n (degree of polymerization) in the above formula (1) is preferably in the range of 10 to 500. When n in the above formula (1) is 10 or more and 500 or less, since a predetermined hardness is easily imparted to surface layer 43*c*, it is preferable.

Further the content of a radically polymerizable vinylic compound in surface layer 43*c* is, from the viewpoint of the hardness, preferably in the range of 40 to 100 parts by volume.

The radically polymerizable vinylic compound (vinylic polymer) is prepared by preparing a cationically polymerizable monomer, and carrying out radical polymerization using the cationically polymerizable monomer.

As manufacture methods of the cationically polymerizable monomer, there are known methods including a method (manufacture method A) of esterifying (meth)acrylic acid with hydroxide group-containing vinyl ethers, a method (manufacture method B) of esterifying a (meth)acrylic acid halide with hydroxy group-containing vinyl ethers, a method (manufacture method C) of esterifying a (meth)acrylic anhydride with hydroxy group-containing vinyl ethers, and a method (manufacture method D) of transesterifying (meth) acrylate esters with hydroxy group-containing vinyl ethers. The cationically polymerizable monomer can be manufactured also by a method (manufacture method E) of esterifying (meth)acrylic acid with a halogen-containing vinyl ether, and a method (manufacture method F) of esterifying a (meth)acrylic acid alkaline (earth) metal salt with a halogen-containing vinyl ether.

Among these manufacture methods, the manufacture method of a vinyl ether group-containing (meth)acrylate ester by transesterification of a (meth)acrylate ester with hydroxy group-containing vinyl ether does not use expensive or hazardous raw materials, thus being industrially advantageous.

The radically polymerizable vinylic compound may be constituted only of a repeating unit represented by the above-mentioned formula (1) or may contain other monomers. Examples of the other monomers include trimethylolpropane triacrylate (TMPTA), pentaerythritol tetraacrylate (PETA), dipentaerythritol tetraacrylate (DPHA), hexanediol diacrylate (HDDA), and cyclohexanedimethanol diacrylate. The content of the other polyfunctional monomers is, from the viewpoint of the hardness, with respect to 100 parts by volume of the radically polymerizable vinylic compound, preferably 40 parts by volume or lower.

The metal oxide fine particle imparts toughness to surface layer 43*c*, and imparts high durability to surface layer 43*c*. The metal oxide fine particle may be a metal oxide fine particle not surface-treated (hereinafter, referred to also as "untreated metal oxide fine particle"), or may be a metal oxide fine particle surface-treated with a predetermined surface treating agent (hereinafter, referred to also as "treated metal oxide fine particle").

The untreated metal oxide fine particle is not especially limited as long as being capable of exhibiting the above-mentioned function. Examples of the untreated metal oxide fine particle include silica (silicon oxide), magnesium oxide, zinc oxide, lead oxide, aluminum oxide (alumina), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide and vanadium oxide. The untreated metal oxide fine particle is, from the viewpoint of imparting the toughness and imparting the durability, preferably titanium oxide, aluminum oxide (alumina), zinc oxide or tin oxide, and more preferably aluminum oxide (alumina) or tin oxide.

As the untreated metal oxide fine particle, an untreated metal oxide fine particle fabricated by a usual manufacture process such as a gas phase process, a chlorine process, a sulfuric acid process, a plasma process or an electrolysis process can be used.

The number average primary particle size of the untreated metal oxide fine particle is, from the viewpoint of the dispersibility and the transmission of light, preferably in the range of larger than 10 nm and 60 nm or smaller.

The number average primary particle size of the untreated metal oxide fine particle can be calculated by taking an enlarged photograph thereof at 10,000X by a scanning electron microscope (JEOL Ltd.), and analyzing photographic images (excluding aggregated particles) of 300 particles taken randomly therefrom by a scanner, by using an automatic image processing analyzer (LUZEX AP, Nireco Corp.) software Ver. 1.32.

In contrast, the metal oxide fine particle has one or both of a radically polymerizable functional group and a low-surface energy functional group on a surface of the metal oxide fine particle.

Examples of radically polymerizable functional groups include (meth)acryloyl groups. Here, the "(meth)acryloyl group" means an acryloyl group or a methacryloyl group. The surface treating agent to be used to fabricate a treated metal oxide fine particle having a (meth)acryloyl group is, for example, a compound having a (meth)acryloyl group.

The compound having a (meth)acryloyl group is preferably a compound having a radically polymerizable functional group such as a carbon-carbon double bond, and a polar group such as an alkoxy group, which is to be coupled with a hydroxy group on the surface of the untreated metal oxide fine particle, in the same molecule.

The compound having a (meth)acryloyl group is preferably a compound which is polymerized (cured) by actinic energy radiation such as ultraviolet rays or electron beams and converted to a resin such as polystyrene or a poly(meth) acrylate. Then, the compound having a (meth)acryloyl group is, from the viewpoint of being curable in a small amount of light or in a short time, more preferably a silane compound having a (meth)acryloyl group.

Examples of compounds having (meth)acryloyl groups include compounds represented by the following formula (2).

[Formula 3]

$$R^{10}-\overset{(R^9)_{3-m}}{\overset{|}{Si}}-X_m \qquad (2)$$

In the formula (2), each $R^9$ independently denotes a hydrogen. atom, a $C_{1-10}$ alkyl group or a $C_{1-10}$aralkyl group; $R^{10}$ denotes an organic group containing a radically polymerizable functional group; each X independently denotes a halogen atom, an alkoxy group, an acyloxy group, an aminoxy group or a phenoxy group; and m denotes an integer of 1 to 3.

Examples of the compound having a (meth)acryloyl group include compounds represented as S-1 to S-31 in Table 1.

TABLE 1

| No. | Structural Formula |
|---|---|
| S-1 | $CH_2{=}CHSi(CH_3)(OCH_3)_2$ |
| S-2 | $CH_2{=}CHSi(OCH_3)_3$ |
| S-3 | $CH_2{=}CHSiCl_3$ |
| S-4 | $CH_2{=}CHCOO(CH_2)_2Si(CH_3)(OCH_3)_2$ |
| S-5 | $CH_2{=}CHCOO(CH_2)_2Si(OCH_3)_3$ |
| S-6 | $CH_2{=}CHCOO(CH_2)_2Si(OC_2H_5)(OCH_3)_2$ |
| S-7 | $CH_2{=}CHCOO(CH_2)_3Si(OCH_3)_3$ |
| S-8 | $CH_2{=}CHCOO(CH_2)_2Si(CH_3)Cl_2$ |
| S-9 | $CH_2{=}CHCOO(CH_2)_2SiCl_3$ |
| S-10 | $CH_2{=}CHCOO(CH_2)_3Si(CH_3)Cl_2$ |
| S-11 | $CH_2{=}CHCOO(CH_2)_3SiCl_3$ |
| S-12 | $CH_2{=}C(CH_3)COO(CH_2)_2Si(CH_3)(OCH_3)_2$ |
| S-13 | $CH_2{=}C(CH_3)COO(CH_2)_2Si(OCH_3)_3$ |
| S-14 | $CH_2{=}C(CH_3)COO(CH_2)_3Si(CH_3)(OCH_3)_2$ |
| S-15 | $CH_2{=}C(CH_3)COO(CH_2)_3Si(OCH_3)_3$ |
| S-16 | $CH_2{=}C(CH_3)COO(CH_2)_2Si(CH_3)Cl_2$ |
| S-17 | $CH_2{=}C(CH_3)COO(CH_2)_2SiCl_3$ |
| S-18 | $CH_2{=}C(CH_3)COO(CH_2)_3Si(CH_3)Cl_2$ |
| S-19 | $CH_2{=}C(CH_3)COO(CH_2)_3SiCl_3$ |
| S-20 | $CH_2{=}CHSi(C_2H_5)(OCH_3)_2$ |
| S-21 | $CH_2{=}C(CH_3)Si(OCH_3)_3$ |
| S-22 | $CH_2{=}C(CH_3)Si(OC_2H_5)_3$ |
| S-23 | $CH_2{=}CHSi(OCH_3)_3$ |
| S-24 | $CH_2{=}C(CH_3)Si(CH_3)(OCH_3)_2$ |
| S-25 | $CH_2{=}CHSi(CH_3)Cl_2$ |
| S-26 | $CH_2{=}CHCOOSi(OCH_3)_3$ |
| S-27 | $CH_2{=}CHCOOSi(OC_2H_5)_3$ |
| S-28 | $CH_2{=}C(CH_3)COOSi(OCH_3)_3$ |
| S-29 | $CH_2{=}C(CH_3)COOSi(OC_2H_5)_3$ |
| S-30 | $CH_2{=}C(CH_3)COO(CH_2)_3Si(OC_2H_5)_3$ |
| S-31 | $CH_2{=}C(CH_3)COO(CH_2)_8Si(OCH_3)_3$ |

Further, the compound having a (meth)acryloyl group may be a compound other than a compound represented by the above-mentioned formula (2). Examples of such a compound having a (meth)acryloyl group include compounds represented by the following formulae (S-32) to (S-34).

[Formula 4]

(S-32)

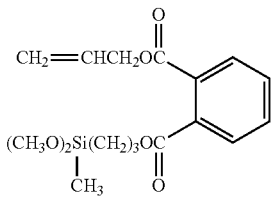

(S-33)

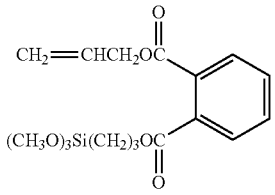

-continued (S-34)

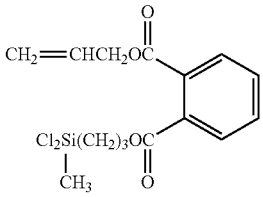

Further, the compound having a (meth)acryloyl group may be an epoxy compound. Examples of such a compound having a (meth)acryloyl group include compounds represented by the following formulae (S-35) to (S-37).

[Formula 5]

(S-35)

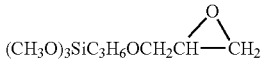

(S-36)

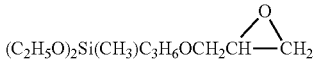

(S-37)

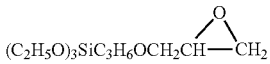

Here, the "low-surface energy functional group" is a functional group introduced by a surface treating agent to be used to lower the surface free energy of the metal oxide fine particle. Examples of the low-surface energy functional group include functional groups in which silicone oil is bonded to silicon atoms of a silane coupling agent, and a polyfluoroalkyl group. Examples of such a surface treating agent to be used to fabricate a treated metal oxide fine particle include straight silicone oils (for example, methyl hydrogen polysiloxane (MHPS)) and modified silicone oils.

Examples of the manufacture method of a treated metal oxide fine particle include a method in which 100 parts by weight of an untreated metal oxide fine particle, 0.1 to 200 parts by weight of a surface treating agent and 50 to 5,000 parts by weight of a solvent are mixed in a wet media dispersion-type apparatus.

Further, examples of other manufacture methods of the treated metal oxide fine particle include a method in which a slurry (suspension of solid particles) containing an untreated metal oxide fine particle and a surface treating agent is stirred. The stirring disintegrates aggregates of the untreated metal oxide fine particle and simultaneously progresses the surface treatment of the untreated metal oxide fine particle. Thereafter, by removing the solvent, the metal oxide fine particle is taken out. Thereby, the metal oxide fine particle uniformly and finely surface-treated with the surface treating agent can be obtained.

The amount a surface treating agent for surface treatment (amount of a surface treating agent covering an untreated metal oxide fine particle) is preferably 0.1 to 20 mass %, and especially preferably 2 to 10 mass % with respect to the metal oxide fine particle.

The content of the metal oxide fine particle (the untreated metal oxide fine particle or the treated metal oxide fine particle) in surface layer 43*c* is preferably 5 to 40 parts by volume, and more preferably 10 to 30 parts by volume. When the content of the metal oxide fine particle is 5 parts by volume or higher, since the hardness of intermediate transfer belt 43 becomes high and the transferability and the durability become high, it is preferable. Further, when the content of the metal oxide fine particle is 40 parts by volume or lower, since it becomes difficult for surface layer 43*c* to be broken and it becomes difficult for coating unevenness during the manufacture described later to be generated, it is preferable.

The thickness of surface layer 43*c* is, from the viewpoint of the protection of base material layer 43*a* and the movement of charges, preferably in the range of 1 to 10 μm.

The layer thickness of surface layer 43*c* can be measured, for example, by a spectrophotometer (MV-3250, JASCO Corp.) using LES361 as a light source unit.

Further, a fact that surface layer 43*c* contains a radically polymerizable vinylic compound of the above-mentioned formula (1) can be checked by an already-known method such as FT-IR or pyrolysis GC-MS.

(Other additives)

Surface layer 43*c* may further contain other additives. The additives are suitably added to surface layer 43*c*, for example, by adding them to a curable composition. The other additives may be added in order to impart physical properties suitable for manufacture of surface layer 43*c* to the curable composition. Examples of the other additives include polymerization initiators, organic solvents, light stabilizers, ultraviolet absorbents, catalysts, colorants, antistatic agents, lubricants, leveling agents, defoaming agents, polymerization accelerators, antioxidants, flame retarders, infrared absorbents, surfactants and surface modifiers.

Surface layer 43*c* can be manufactured by a conventionally well-known usual method. Surface layer 43*c* can be formed, for example, by applying a curable composition containing the above-mentioned metal oxide fine particle and the radically polymerizable vinylic compound represented by the above-mentioned formula (1) on base material layer 43*a*, and irradiating the applied curable composition with actinic energy radiation so that the total quantity of the light becomes a predetermined one.

EXAMPLES

Hereinafter, the present invention will be described in more detail by way of Examples, but the present invention is not limited thereto.

1. Preparation of Materials (1) Fabrication of Base Material Layer 100 parts by volume of a polyphenylene sulfide resin (E2180, Toray Industries, Inc.), 16 parts by volume of a conductive filler (Furnace #3030B, Mitsubishi Chemical Corp.), 1 part by volume of a graft copolymer (Modiper A4400, NOF Corp.), and 0.2 part by volume of a lubricant (calcium montanate) were charged in a single-screw extruder, and melt-kneaded to thereby make a resin mixture.

Then, the kneaded resin mixture was extruded into a seamless belt shape by using a single-screw extruder having a ring die, having a slit-like seamless belt-shaped discharge port, attached to the front end thereof. Then, the extruded seamless belt-shaped resin mixture was applied over a cylindrical cooling tube, and cooled and solidified in the cylindrical cooling tube installed ahead of the discharge port to thereby fabricate a 120 μm-thick seamless cylindrical (endless belt-shape) resin base material layer for an intermediate transfer belt.

(2) Preparation of Vinylic Polymers

In the present Examples, first, cationically polymerizable vinylic compounds (monomers) were prepared, and vinylic polymers were prepared by using the cationically polymerizable monomers.

a. Preparation of Cationically Polymerizable Monomers

To a glass-made 3-L five-necked flask equipped with a stirring apparatus, a thermometer, an Oldershaw-type fractionating column, a gas introducing tube and a liquid adding line, 793 g of diethylene glycol monovinyl ether (DEGV, Maruzen Petrochemical Co., Ltd.) as the hydroxy group-containing vinyl ethers, 1,502 g of ethyl acrylate (AE, Kanto Chemical Co., Inc.) as the (meth)acrylate esters, 300 mg of methoxyhydroquinone (MEHQ, Tokyo Chemical Industry Co., Ltd.) as the polymerization inhibitor, and 10 g of dibutyltin oxide (DBTO, Tokyo Chemical Industry Co., Ltd.) as the catalyst were added. At this time, the amount of moisture in the whole system was measured by an MKS510-type Karl Fisher moisture meter (Kyoto Electronics Mfg. Co., Ltd.; hereinafter, referred to as "moisture meter"; indicator: Hydranal Composite 5K (RdH Laborchemikalien GmbH&Co. KG)). The amount of moisture measured using dehydration solvent KT (manufactured by Mitsubishi Chemical Co., Ltd.) as a solvent was 0.1 wt. %. The mixture was mixed and stirred and put in an oil bath at 130° C., and started to be heated, while air was being introduced to a liquid phase part through the gas introducing tube. The reaction was continued for 12 hours while ethyl acrylate in a weight equivalent to a weight of ethyl acrylate in an ethyl acrylate-ethanol azeotropic composition to be distilled out from the column top of the Oldershaw-type fractionating column was being continuously added to the reaction system through the liquid adding line, to thereby obtain a No. 1 cationically polymerizable monomer. Further, No. 2 to No. 7 cationically polymerizable monomers were prepared as in the No. 1 cationically polymerizable monomer, except for using compounds in predetermined amounts indicated in Table 2. By the way, when methyl methacrylate was used as the (meth)acrylate esters, methyl methacrylate in a weight equivalent to a weight of methyl methacrylate in a methyl methacrylate-methanol azeotropic composition to be distilled out was continuously added to the reaction system through the liquid adding line.

AE in Table 2 is ethyl acrylate; and MMA is methylmethacrylate (Mitsubishi Chemical Co., Ltd.). Further, DEGV is diethylene glycol monovinyl ether (Maruzen Petrochemical Co., Ltd.); TEGV is triethylene glycol monovinyl ether (Kingston Chemistry); BDV is 1,4-butanediol monovinyl ether (Nippon Carbide Industries, Co., Inc.); HDV is 1,6-hexanediol monovinyl ether prepared by the following method; HEV is 2-hydroxyethyl vinyl ether (Nippon Carbide Industries, Co., Inc.); and NODV is 1,9-nonanediol monovinyl ether prepared by the following method. Further, MEHQ is methoxyhydroquinone (Tokyo Chemical Industry Co., Ltd.); and DBTO is dibutyltin oxide (Tokyo Chemical Industry Co., Ltd.).

b. Preparation of 1,6-Hexanediol Monovinyl Ether and 1,9-Nonanediol Monovinyl Ether 437.8 g of a 99 wt. %-purity 1,6-hexanediol (Kanto Chemical Co., Inc.) was melted at 50° C. in a 2,000-mL SUS-made pressure resistant vessel, and thereafter, 30.0 g of a 95.6wt. %-purity potassium hydroxide (Kanto Chemical Co., Inc.) was added. Then, the reaction vessel was sealed; and the mixture was heated up to 120° C. under stirring, and produced water was distilled out over 4 hours while the reaction vessel interior atmosphere was replaced by nitrogen by making nitrogen gas to flow at a flow rate of 1,000 mL/min. Then, the reaction vessel internal temperature was raised to about 130° C.; and acetylene (Taiyo Nippon Sanso Gas & Welding Corp.) was introduced under a pressure of 4 to 8 kg/cm$^2$. The reaction was carried out for 4.1 hours while the reaction vessel internal pressure was held at about 4 to 8 kg/cm$^2$ by successively replenish acetylene. After the termination of the reaction, remaining acetylene gas was purged to thereby obtain a reaction liquid. The obtained reaction liquid was charged in a 2,000-mL three-necked flask with a distilling column packed with Raschig rings; 101.2 g of distilled water was added; and the reaction liquid was rectified at an internal temperature of 172 to 202° C. at a reflux ratio of 1 to thereby separate and collect 1,6-hexanediol monovinyl ether. 1,9-Nonanediol was similarly prepared, except for altering 437.8 g of 1,6-hexanediol to 601.1 g of 1,9-nonanediol.

TABLE 2

| Cationically | (Meth)acrylate Esters | | Hydroxide-Containing Vinyl Ethers | | Radical Polymerization Inhibitor | | Catalyst | | |
|---|---|---|---|---|---|---|---|---|---|
| Polymerizable Monomer No. | Kind | Charging Amount (g) | Kind | Charging Amount (g) | Kind | Charging Amount (g) | Kind | Charging Amount (g) | Amount of moisture (wt %) |
| 1 | AE | 1502 | DEGV | 793 | MEHQ | 300 | DBTO | 10 | 0.1 |
| 2 | MMA | 1502 | DEGV | 793 | MEHQ | 300 | DBTO | 10 | 0.1 |
| 3 | AE | 1502 | TEGV | 1058 | MEHQ | 300 | DBTO | 10 | 0.1 |
| 4 | AE | 1502 | BDV | 697 | MEHQ | 300 | DBTO | 10 | 0.1 |
| 5 | AE | 1502 | HDV | 865 | MEHQ | 300 | DBTO | 10 | 0.1 |
| 6 | AE | 1502 | HEV | 793 | MEHQ | 300 | DBTO | 10 | 0.1 |
| 7 | AE | 1502 | NODV | 1118 | MEHQ | 300 | DBTO | 10 | 0.1 |

c. Preparation of Vinylic Polymers (Vinylic Compounds)

To a four-necked flask equipped with a stirring rod, a thermometer, dropping lines and a nitrogen/air mixed gas introducing tube, 80 g of toluene (Kanto Chemical Co., Inc.) was charged; and the temperature was regulated at 25° C. After the temperature regulation, 200 g of the No. 1 cationically polymerizable monomer, and a mixed solution of 27 g of ethyl acetate (Kanto Chemical Co., Inc.) and 13.5 mg of phosphotungstic acid (Wako Pure Chemical Industries, Ltd.) were dropped over 2 hours, respectively. After the termination of the dropping, the polymerization reaction was successively carried out at 25° C. for 30 min, and thereafter, trimethylamine was added to terminate the reaction. Then, the reaction liquid was concentrated by an evaporator, and thereafter vacuum-dried. A No. 1 vinylic polymer was obtained by the above. Further Nos. 2 to 11 vinylic polymers were prepared by the same method as the method or No. 1 vinylic polymer under the conditions indicated in Table 3.

TABLE 3

| Vinylic Polymer No. | Cationically Polymerizable Monomer: Cationically Polymerizable Monomer No. | Cationically Polymerizable Monomer: Charging Amount (g) | Toluene (g) | Ethyl Acetate (g) | Phosphotungstic Acid (mg) | Reaction Temperature (° C.) | Dropping Time (hour) | Additional Reaction Time (min) | Degree of Polymerization (n) | The Number of Carbon Atoms in $R^1$ | m | $R^2$ |
|---|---|---|---|---|---|---|---|---|---|---|---|---|
| 1 | 1 | 200 | 80 | 27 | 13.5 | 25 | 2 | 30 | 100 | 2 | 2 | H |
| 2 | 2 | 200 | 80 | 27 | 13.5 | 25 | 2 | 30 | 100 | 2 | 2 | $CH_3$ |
| 3 | 3 | 200 | 80 | 27 | 13.5 | 25 | 2 | 30 | 100 | 2 | 3 | H |
| 4 | 4 | 200 | 80 | 27 | 13.5 | 25 | 2 | 30 | 100 | 4 | 1 | H |
| 5 | 5 | 200 | 80 | 27 | 13.5 | 25 | 2 | 30 | 100 | 6 | 1 | H |
| 6 | 1 | 400 | 100 | 27 | 15.0 | 25 | 3 | 60 | 200 | 2 | 2 | H |
| 7 | 1 | 50 | 80 | 27 | 13.5 | 25 | 2 | 30 | 50 | 2 | 2 | H |
| 8 | 1 | 50 | 40 | 10 | 10.0 | 25 | 2 | 0 | 20 | 2 | 2 | H |
| 9 | 1 | 25 | 40 | 10 | 10.0 | 25 | 2 | 0 | 8 | 2 | 2 | H |
| 10 | 6 | 200 | 80 | 27 | 13.5 | 25 | 2 | 30 | 100 | 2 | 1 | H |
| 11 | 7 | 200 | 80 | 27 | 13.5 | 25 | 2 | 30 | 100 | 9 | 1 | H |

(3) Preparation of Metal Oxide Fine Particles 100 parts by weight of tin oxide, silica or alumina, 15 parts by weight of a surface treating agent, and 400 parts by weight of a solvent (a mixed solvent of toluene : isopropyl alcohol=1:1 (weight ratio))) were charged in a wet media dispersion-type apparatus, mixed and thereafter dispersed; and the solvent was thereafter removed. Then, the resultant was dried at 150° C. for 30 min to thereby obtain Nos. 1 to 6 metal oxide fine particles (treated metal oxide fine particles) each indicated in Table 4. Further, tin oxide not treated with a surface treating agent was used as a No. 7 metal oxide fine particle (untreated metal oxide fine particle).

Tin oxide in Table 4 used was Nanotek (R) SnO2 (CIK Nanotek Corp.) having an average particle diameter of 21 nm; alumina used was Nanotek A1203 (CIK Nanotek Corp.) having an average particle diameter of 34 nm; and silica used was AEROSIL 50 (Nippon Aerosil Co., Ltd.) having an average particle diameter of 30 nm.

KBM-5103 was 3-acryloxypropyltrimetoxysilane (Shin-Etsu Chemical Co., Ltd.); and KF-9901 was methylhydrogenpolysiloxane (Shin-Etsu Chemical Co., Ltd.). The surface treating agent using KBM-5103 and KF-9901 was a mixture of KBM-5103: KF-9901=5:3 (weight ratio).

TABLE 4

| Metal Oxide Fine Particle No. | Kind | Surface Treating Agent |
|---|---|---|
| 1 | tin oxide | KBM-5103, KF-9901 |
| 2 | tin oxide | KBM-5103 |
| 3 | tin oxide | KF-9901 |
| 4 | alumina | KBM-5103, KF-9901 |
| 5 | alumina | KF-9901 |
| 6 | silica | KBM-5103, KF-9901 |
| 7 | tin oxide | — |

2. Manufacture of Intermediate Transfer Members

Example 1

(1) Preparation of Coating Solution (Curable Composition) for Forming Surface Layer 75 parts by volume of the No. 1 vinylic polymer indicated in Table 3 and 25 parts by volume of the No. 1 metal oxide fine particle indicated in Table 4 were dissolved and dispersed in methyl isobutyl ketone (MIBK) being a solvent so that the solid content concentration became 10 mass %, to thereby prepare a coating solution curable composition) for forming a surface layer.

(2) Formation of Surface Layer

The coating solution for forming a surface layer was coated at 1 L/min on the outer peripheral surface of the base material layer by a dip coating method using a coating apparatus so that the dry coating thickness became 5 μm, to thereby form a coating layer.

Then, the coating layer was irradiated with ultraviolet rays as actinic radiation (actinic energy radiation) under the following irradiation condition to cure the coating layer to thereby form a surface layer. By the above steps, No. 1 intermediate transfer member was obtained. Here, the irradiation of the ultraviolet rays was carried out with a light source being fixed and with the coating layer on the outer peripheral surface of the base material layer being rotated at a circumferential speed of 60 mm/sec.

(Irradiation Condition of Ultraviolet Rays)

Light source: a 365-nm LED light source (SPX-TA, Revox Inc.)

Distance from an irradiation port to the surface of the coating layer: 100 mm

Atmosphere: nitrogen

Quantity of irradiation light: 1 J/cm$^2$

Irradiation time (rotation time): 240 sec

Example 2

No. 2 intermediate transfer member was obtained as in Example 1, except for altering the No. 1 metal oxide fine particle to the No. 2 metal oxide fine particle, which was prepared by surface-treating tin oxide with KBM-5103.

Example 3

No. 3 intermediate transfer member was obtained as in Example 1, except for altering the No. 1 metal oxide fine particle to the No. 3 metal oxide fine particle, which was prepared by surface-treating tin oxide with KF-9901.

Example 4

No. 4 intermediate transfer member was obtained as in Example 1, except for altering the No. 1 vinylic polymer to the No. 2 vinylic polymer.

Example 5

No. 5 intermediate transfer member was obtained as in Example 1, except for altering the addition amount of the No. 1 vinylic polymer to 85 parts by volume, and the addition amount of the No. 1 metal oxide fine particle to 15 parts by volume.

Example 6

No. 6 intermediate transfer member was obtained as in Example 1, except for altering the addition amount of the No. 1 vinylic polymer to 70 parts by volume, and the addition amount of the No. 1 metal oxide fine particle to 30 parts by volume.

Example 7

No. 7 intermediate transfer member was obtained as in Example 1, except for altering the addition amount of the No. 1 vinylic polymer to 50 parts by volume, and further adding 25 parts by volume of trimethylolpropane triacrylate (TMPTA) as a polyfunctional (meth)acrylate. Here, trimethylolpropane triacrylate used was SR351 (Sartomer Japan Inc.).

Example 8

No. 8 intermediate transfer member was obtained as in Example 1, except for altering the No. 1 metal oxide fine particle to the No. 4 metal oxide fine particle, which was prepared by surface-treating alumina with KBM-5103 and KF-9901.

Example 9

No. 9 intermediate transfer member was obtained as in Example 1, except for altering the No. 1 metal oxide fine particle to the No. 5 metal oxide fine particle, which was prepared by surface-treating alumina with KF-9901.

Example 10

No. 10 intermediate transfer member was obtained as in Example 1, except for altering the No. 1 metal oxide fine particle to the No. 6 metal oxide fine particle, which was prepared by surface-treating silica with KBM-5103 and KF-9901.

Example 11

No. 11 intermediate transfer member was obtained as in Example 10, except for altering the addition amount of the No. 6 metal oxide fine particle to 40 parts by volume.

Example 12

No. 12 intermediate transfer member was obtained as in Example 1, except for altering the No. 1 vinylic polymer to the No. 3 vinylic polymer.

Example 13

No. 13 intermediate transfer member was obtained as in Example 1, except for altering the No. 1 vinylic polymer to the No. 4 vinylic polymer.

Example 14

No. 14 intermediate transfer member was obtained as in Example 1, except for altering the No. 1 vinylic polymer to the No. 5 vinylic polymer.

Example 15

No. 15 intermediate transfer member was obtained as in Example 8, except for altering the No. 1 vinylic polymer to the No. 6 vinylic polymer.

Example 16

No. 16 intermediate transfer member was obtained as in Example 1, except for altering the No. 1 vinylic polymer to the No. 7 vinylic polymer.

Example 17

No. 17 intermediate transfer member was obtained as in Example 8, except for altering the No. 1 vinylic polymer to the No. 8 vinylic polymer.

Example 18

No. 18 intermediate transfer member was obtained as in Example 1, except for altering the No. 1 metal oxide fine particle to the No. 7 metal oxide fine particle, which was tin oxide not having been surface-treated.

Example 19

No. 19 intermediate transfer member was obtained as in Example 1, except for altering the No. 1 vinylic polymer to pVEEA (Nippon Shokubai Co., Ltd.).

Comparative Example 1

No. 20 intermediate transfer member was obtained as in Example 10, except for altering the No. 1 vinylic polymer to the No. 9 vinylic polymer.

Comparative Example 2

No. 21 intermediate transfer member was obtained as in Example 1, except for altering the No. 1 vinylic polymer to the No. 10 vinylic polymer.

Comparative Example 3

No. 22 intermediate transfer member was obtained as in Example 1, except for altering the No. 1 vinylic polymer to the No. 11 vinylic polymer.

Comparative Example 4

No. 23 intermediate transfer member was obtained as in Example 1, except for adding no metal oxide fine particle.

Comparative Example 5

No. 24 intermediate transfer member was obtained as in Example 1, except for altering the No. 1 vinylic polymer to DPHA (Nippon Kayaku Co., Ltd.).

Comparative Example 6

No. 25 intermediate transfer member was obtained as in Example 1, except for altering the No. 1 vinylic polymer to 50 parts by volume of DPHA (Nippon Kayaku Co., Ltd.) and 25 parts by volume of PEG diacrylate (A-400, Shin-Nakamura Chemical Co., Ltd.).

There are shown in Table 5 compositions of surface layers in the Nos. 1 to 25 intermediate transfer members.

TABLE 5

| Item | Intermediate Transfer Member No. | Vinylic Polyme | | Polyfunctional (Meth)acrylate | | Acryl Monomer | | Metal Oxide Fine Particle | |
|---|---|---|---|---|---|---|---|---|---|
| | | Vinylic Polymer No. | Addition Amount (parts by volume) | Kind | Addition Amount (parts by volume) | Kind | Addition Amount (parts by volume) | Metal Oxide Fine Particle No. | Addition Amount (parts by volume) |
| Example | 1 | 1 | 75 | — | — | — | — | 1 | 25 |
| | 2 | 1 | 75 | — | — | — | — | 2 | 25 |
| | 3 | 1 | 75 | — | — | — | — | 3 | 25 |
| | 4 | 2 | 75 | — | — | — | — | 1 | 25 |
| | 5 | 1 | 85 | — | — | — | — | 1 | 15 |
| | 6 | 1 | 70 | — | — | — | — | 1 | 30 |
| | 7 | 1 | 50 | TMPTA | 25 | — | — | 1 | 25 |
| | 8 | 1 | 75 | — | — | — | — | 4 | 25 |
| | 9 | 1 | 75 | — | — | — | — | 5 | 25 |
| | 10 | 1 | 75 | — | — | — | — | 6 | 25 |
| | 11 | 1 | 75 | — | — | — | — | 6 | 40 |
| | 12 | 3 | 75 | — | — | — | — | 1 | 25 |
| | 13 | 4 | 75 | — | — | — | — | 1 | 25 |
| | 14 | 5 | 75 | — | — | — | — | 1 | 25 |
| | 15 | 6 | 75 | — | — | — | — | 4 | 25 |
| | 16 | 7 | 75 | — | — | — | — | 1 | 25 |
| | 17 | 8 | 75 | — | — | — | — | 4 | 25 |
| | 18 | 1 | 75 | — | — | — | — | 7 | 25 |
| | 19 | pVEEA | 75 | — | — | — | — | 1 | 25 |
| Comparative Example | 20 | 9 | 75 | — | — | — | — | 6 | 25 |
| | 21 | 10 | 75 | — | — | — | — | 1 | 25 |
| | 22 | 11 | 75 | — | — | — | — | 1 | 25 |
| | 23 | 1 | 100 | — | — | — | — | — | — |
| | 24 | — | — | DPHA | 75 | — | — | 1 | 25 |
| | 25 | | — | DPHA | 50 | PEG diacrylate | 25 | 1 | 25 |

2. Evaluations

For the fabricated Nos. 1 to 25 intermediate transfer members, the following evaluation tests were carried out.

(1) Crack Resistance Test

The crack resistance test was carried out according to JIS P8115. The load in the crack resistance test was made to be 250 gf, and a 0.38 μm-R cramp was used. The test speed was made to be 175 cpm; and the bending angle was made to be 90°. The evaluation criteria were as follows; and cases where the evaluation results were "A", "B" and "C" were determined to be usable.

A: the MIT value was 1,000 times or more.

B: the MIT value was 500 times or more, and less than 1,000 times.

C: the MIT value was 100 times or more, and less than 500 times.

D: the MIT value was less than 100 times.

(2) Evaluation of Cleanability

As an evaluation machine for evaluating cleanability, a full-color image forming apparatus (bizhub C554 (laser light exposure, reversal development, tandem color multifunctional peripheral of intermediate transfer members) manufactured by Konica Minolta Business Technologies Inc.) as illustrated in FIG. 1, which is capable of mounting the No. 1 to No. 25 intermediate transfer members, was prepared. Then, the each intermediate transfer member was mounted on the evaluation machine, and the cleanability after the durability test was evaluated.

More specifically, the durability test was carried out, in which images having a coverage rate of each color of yellow (Y), magenta (M), cyan (C) and black (Bk) of 2.5% were printed at 20° C. and 50%RH on 600,000 sheets of neutral paper. After the durability test, 100 sheets of solid images having a coverage rate of cyan (C) of 100% were printed, and thereafter, solid images having a coverage rate of yellow (Y) of 100% were outputted; and the evaluation was carried out according to the following evaluation criteria. The evaluation criteria were as follows; and when the evaluation results were "A", "B" and "C", it was determined to be usable.

A: No streaks of fouling due to cleaning failure were generated at all in the printed images.

B: streaks of fouling due to cleaning failure were generated in the printed images, but the outputting of 10 sheets made the streaks disappear.

C: streaks of fouling due to cleaning failure were slightly generated in the printed images.

D: streaks of fouling were obviously generated in the printed images.

(4) Evaluation of Transfer Rate

As an evaluation machine for evaluating the transfer rate, a full-color image forming apparatus (bizhub(R) PRESS C8000, manufactured by Konica Minolta, Inc.), as illustrated in FIG. 1, which is capable of mounting intermediate transfer members 1 to 25, was prepared. Then, the each intermediate transfer member was mounted on the evaluation machine, and the transfer rates before and after the durability test described before were determined.

More specifically, the durability test was carried out, in which images having a coverage rate of each color of yellow (Y), magenta (M), cyan (C) and black (Bk) of 2.5% were printed at 20° C. and 50%RH on 600,000 sheets of neutral paper. In the early stage of the durability test and after the durability test, respectively, the weight A (g) of the toner on an intermediate transfer member before secondary transfer and the weight B (g) of the toner remaining on the intermediate transfer member after the secondary transfer were measured; and the transfer rate (%) was determined from the following expression. The weight A was determined from the result of the toner collected from three regions of a predetermined area (10 mm x 50 mm) of the surface of the intermediate transfer member after the primary transfer and before the secondary transfer by a suction apparatuses. With respect to the weight B, the toner remaining on the intermediate transfer member after the secondary transfer was collected by a Booker tape; the Booker tape was pasted on a white sheet; the color of the white sheet was measured by using a spectrocolorimeter (Konica Minolta Sensing Inc., CM-2002), and the weight B was determined from a relation between the toner weight previously measured and the colorimetric value for calibration. The evaluation criteria were as follows; and when the evaluation results were "A", "B" and "C", it was determined to be usable.

(Expression)

$$\text{Transfer rate (\%)}=\{1-(B/A)\}\times 100$$

A: the transfer rate was 98% or higher.

B: the transfer rate was 95% or higher and lower than 98%.

C: the transfer rate was 90% or higher and lower than 95%.

D: the transfer rate was lower than 90%.

The evaluation results of the crack resistance test, the cleanability and the transfer rate are shown in Table 6.

TABLE 6

| Item | Intermediate Transfer Member No. | Crack Resistance | Cleanability | Transfer Rate |
|---|---|---|---|---|
| Example | 1 | A | B | B |
| | 2 | B | A | A |
| | 3 | A | B | C |
| | 4 | A | B | B |
| | 5 | A | B | C |
| | 6 | B | A | A |
| | 7 | B | B | B |
| | 8 | A | B | B |
| | 9 | A | B | B |
| | 10 | A | B | C |
| | 11 | C | B | C |
| | 12 | A | B | B |
| | 13 | A | B | B |
| | 14 | A | B | C |
| | 15 | B | A | C |
| | 16 | A | B | B |
| | 17 | A | B | C |
| | 18 | A | C | C |
| | 19 | A | B | A |
| Comparative Example | 20 | B | C | D |
| | 21 | D | B | B |
| | 22 | A | D | B |
| | 23 | A | D | B |
| | 24 | D | B | A |
| | 25 | D | D | D |

As shown in Table 6, the Nos. 1 to 19 intermediate transfer members containing the metal oxide fine particles and the structural unit represented by the above-mentioned formula (1) were good in any of the crack resistance, the cleanability and the transferability.

Particularly, the Nos. 1 to 10 and 12 to 19 intermediate transfer members, in which the addition amount of the metal oxide fine particles was in the range of 10 to 30 parts by volume, were better in the crack resistance, as compared with the No. 11 intermediate transfer member, in which the addition amount of the metal oxide fine particle was 40 parts by volume.

Further, the Nos. 1 to 17 intermediate transfer members, in which the metal oxide fine particles had one or both of a radically polymerizable functional group and a low-surface energy functional group on their surface, were better in the cleanability and the transferability, as compared with the No. 18 intermediate transfer member, which used an untreated metal oxide fine particle.

Further, the Nos. 2, 8, 10, 15 and 17 intermediate transfer members, in which their radically polymerizable functional group was a (meth)acryloyl group, were better in the transfer rate than the Nos. 1, 3 to 7, 9, 11 to 14 and 16 intermediate transfer members, in which the radically polymerizable functional group was not a (meth)acryloyl group or was another functional group.

The No. 20 intermediate transfer member, in which the degree of polymerization n of the vinylic compound was lower than 9, was inferior in the transfer rate. This is conceivably because the hardness of the surface layer was low due to a low degree of polymerization n of the vinylic compound.

The No. 23 intermediate transfer member, in which no metal oxide fine particle was added, was inferior in the cleanability. This is conceivably because the toughness and the durability of the surface layer were not imparted due to the absence of edition of a metal oxide fine particle to the No. 23intermediate transfer member.

The No. 24 intermediate transfer member, which contained no structural unit represented by the above-mentioned formula (1), was inferior in the crack resistance; and the No. 25 intermediate transfer member was inferior in the crack resistance and the cleanability, and was low in the transfer rate.

As described hitherto, the intermediate transfer members according to the present embodiments, since containing the structural unit represented by the formula (1), were good in any of the crack resistance, the cleanability and the transferability. Further, the intermediate transfer members according to the present embodiments, since their surface layer was cured by irradiation with ultraviolet rays, could be manufactured inexpensively.

What is claimed is:

1. An intermediate transfer member, comprising: a base material layer; and a surface layer on the base material layer, wherein the surface layer is a cured substance of a composition comprising a radically polymerizable vinylic compound and a metal oxide particle; and the vinylic compound has a structural unit represented by formula (1):

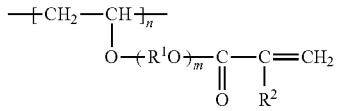

(1)

wherein each $R^1$ independently denotes a $C_{2-8}$ alkylene group; each $R^2$ independently denotes a hydrogen atom or a methyl group; and m denotes a positive number, and n denotes a positive number of 10 or more.

2. The intermediate transfer member according to claim 1, wherein the metal oxide particle has a structure derived from one or both of a radically polymerizable functional group and a low-surface energy functional group on a surface of the metal oxide particle.

3. The intermediate transfer member according to claim 2, wherein the metal oxide particle has a radically polymerizable functional group on a surface thereof; and the radically polymerizable functional group of the metal oxide particle comprises a (meth)acryloyl group.

4. The intermediate transfer member according to claim 1, wherein the base material layer comprises a polyphenylene sulfide.

5. The intermediate transfer member according to claim 1, wherein m in the formula (1) is 1 on more and 5 or less.

6. The intermediate transfer member according to claim 1, wherein the surface layer has a thickness of 1 μm or larger and 10 μm or smaller.

7. The intermediate transfer member according to claim 1, wherein the surface layer has a content of the metal oxide particle of 10 parts by volume or higher and 30 parts by volume or lower.

8. The intermediate transfer member according to claim 1, wherein the metal oxide particle comprises titanium oxide, aluminum oxide, zinc oxide or tin oxide.

9. The intermediate transfer member according to claim 1, wherein the metal oxide particle has a number average primary particle size of larger than 10 nm and 60 nm or smaller.

10. The intermediate transfer member according to claim 1, wherein the metal oxide particle has a structure derived from a silane compound having a (meth)acryloyl group.

11. The intermediate transfer member according to claim 10, wherein silane compound having a (meth)acryloyl group has a structure derived from a compound represented by formula (2):

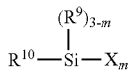

(2)

wherein each $R^9$ independently denotes a hydrogen atom, a $C_{1-10}$ alkyl group or a $C_{1-10}$ aralkyl group; $R^{10}$ denotes an organic group containing a radically polymerizable functional group; each X independently denotes a halogen atom, an alkoxy group, an acyloxy group, an aminoxy group or a phenoxy group; and m denotes an integer of 1 to 3.

12. The intermediate transfer member according to claim 1, wherein the base material layer has an electric resistance value of $10^5$ Ω·cm or higher and $10^{11}$ Ω·cm or lower.

13. The intermediate transfer member according to claim 1, wherein an elastic layer is present between the base material layer and the surface layer.

14. The intermediate transfer member according to claim 1, wherein the intermediate transfer member is an endless belt.

15. An image forming apparatus, comprising an intermediate transfer member according to claim 1 that transfers a toner image formed on a photoconductor to a recording medium.

* * * * *